US007487652B2

(12) United States Patent
Marszalek et al.

(10) Patent No.: US 7,487,652 B2
(45) Date of Patent: Feb. 10, 2009

(54) BRACKET, SYSTEM AND METHOD FOR SECURING A DEVICE TO A FIXTURE

(75) Inventors: Christopher Marszalek, Plainfield, IL (US); Daniel Horvath, Marseilles, IL (US)

(73) Assignee: Sennco Solutions, Inc., Plainfield, IL (US)

( * ) Notice: Subject to any disclaimer, the term of this patent is extended or adjusted under 35 U.S.C. 154(b) by 341 days.

(21) Appl. No.: 11/299,422

(22) Filed: Dec. 12, 2005

(65) Prior Publication Data

US 2006/0086160 A1 Apr. 27, 2006

Related U.S. Application Data

(63) Continuation-in-part of application No. 10/861,052, filed on Jun. 3, 2004.

(51) Int. Cl.
*E05B 69/00* (2006.01)

(52) U.S. Cl. ..... 70/58; 70/14; 70/18; 70/164; 248/553

(58) Field of Classification Search ..... 70/14, 70/18, 19, 58, 164; 292/551–553
See application file for complete search history.

(56) References Cited

U.S. PATENT DOCUMENTS 3,410,122 A * 11/1968 Moses ..... 70/58
3,965,705 A * 6/1976 Nadler ..... 70/58
4,453,692 A * 6/1984 LeDoux et al. ..... 248/552
5,052,198 A * 10/1991 Watts ..... 70/58
5,052,199 A * 10/1991 Derman ..... 70/58
5,085,395 A * 2/1992 Frater et al. ..... 248/552
5,582,044 A * 12/1996 Bolich ..... 70/58
5,676,258 A 10/1997 Leyden et al.
5,709,110 A * 1/1998 Greenfield et al. ..... 70/58
5,709,367 A * 1/1998 Heintz et al. ..... 248/551
5,794,463 A * 8/1998 McDaid ..... 70/18
5,836,183 A * 11/1998 Derman ..... 70/58
5,914,461 A * 6/1999 Brandt ..... 174/135
6,173,591 B1 * 1/2001 Derman ..... 70/58
6,216,499 B1 * 4/2001 Ronberg et al. ..... 70/58
6,308,928 B1 * 10/2001 Galant ..... 248/553
6,443,417 B2 * 9/2002 Galant ..... 248/553
6,450,472 B1 * 9/2002 Cook, Jr. ..... 248/551
6,711,921 B1 * 3/2004 Yang ..... 70/58
6,763,690 B2 * 7/2004 Galant ..... 70/58

(Continued)

*Primary Examiner*—Suzanne D Barrett
(74) *Attorney, Agent, or Firm*—Patents + TMS, P.C.

(57) ABSTRACT

A bracket, a system and a method secure a device to a fixture. The bracket has a first mount, a second mount and/or a first shaft for receiving and/or for securing the device to the bracket. A second shaft is attachable to the first mount and/or the second mount via an opening in the first mount and/or the second mount. A first end of a cable is connectable and/or is attachable to the second arm of the bracket. A second end of the cable is attached to, is connected to and/or is secured to the fixture. The device and/or the bracket is attached to, is connected to and/or is secured to the fixture via the cable. The first arm and/or the second arm has a length which corresponds to a length of the device. The bracket attaches to devices having different lengths. The first mount and/or the second mount has apertures for receiving the first arm which corresponds to a thickness of the device. The bracket attaches to devices having different thicknesses.

18 Claims, 10 Drawing Sheets

U.S. PATENT DOCUMENTS 7,007,912 B1 * 3/2006 Giuliani et al. ..... 248/552
7,174,752 B2 * 2/2007 Galant ..... 70/58
7,204,106 B2 * 4/2007 Merrem et al. ..... 70/14
2004/0177658 A1 * 9/2004 Mitchell ..... 70/58
2005/0268673 A1 * 12/2005 Bakker et al. ..... 70/58
2006/0150692 A1 * 7/2006 Chang et al. ..... 70/58
2006/0266086 A1 * 11/2006 Bakker et al. ..... 70/58

* cited by examiner

BRACKET, SYSTEM AND METHOD FOR SECURING A DEVICE TO A FIXTURE

This application is a Continuation-In-Part Application of co-pending U.S. patent application Ser. No. 10/861,052 filed on Jun. 3, 2004.

BACKGROUND OF THE INVENTION

The present invention generally relates to a bracket as well as a system and a method for securing a device. More specifically, the present invention relates to a bracket, a system and a method for securing a device to a fixture. The bracket may have a first mount and/or a second mount. The first mount may be attached to and/or may be connected to the second mount via a first arm. The first mount may be movable from a first position to a second position with respect to the second mount. The first position or the second position may be based on and/or may correspond to a length of the device. The device may be insertable between the first arm and the first mount and/or the second mount. As a result, the device may be connected, may be attached to and/or may be secured to the bracket via the first arm. A second arm may be insertable into an opening of the first mount and/or the second mount to attach the first mount to the second mount. A first end of a cable may be attached to and/or may be connected to the second arm via a connector which may be located between the openings of the first mount and the second mount. Alternatively, a pin may extend outward with respect to the second arm and/or the first mount to attach the first end of the cable to the bracket. A second end of a cable may be attached to, may be secured to and/or may be connected to the fixture. A locking member may be attached to the second arm or the pin to secure the cable to the second arm. As a result, the device and/or the bracket may be secured to, may be attached to and/or may be connected to the fixutre via the second arm or the pin.

It is generally known that, for example, a vendor, a wholesaler and/or a retailer (hereinafter "seller") displays portable electronic devices. The portable electronic device is, for example, a laptop. Often, a customer examines and/or utilizes the portable electronic device before deciding to purchase the portable electronic device from seller. The seller may secure the portable electronic device to a fixture in the showroom to prevent theft of the device by a customer. The device on display may be secured to the fixture by a cable and/or an assembly. Traditionally, the cable may be thin which may allow the cable to be cut and/or the device to be separated from the fixture. The assembly attaches and/or locks the device to the fixture. The assembly may be disassembled and/or may allow the device to be separated from the fixture. Further, the cable and/or the assembly may prohibit the customer from lifting, manipulating and/or examining the device on display in the showroom. Still further, the cable and/or the assembly are expensive, complicated to assemble and/or are ineffective in securing the device to the fixture. Moreover, the cable and/or the assembly fail to prevent the device from being separated from the fixture. As a result, the cable and/or the assembly are ineffective in preventing the theft of and/or the destruction of the device.

Often, the assembly secures the device, such as, for example, the laptop to the fixture with a rod. The rod extends across a keyboard of the laptop computer for attaching the device to the fixture. As a result, the laptop computer is secured between the rod and the fixture. However, the rod prohibits the customer from lifting the laptop computer from the fixture for examination. The laptop computer may only be lifted from the fixture by detaching the rod and/or by separating the laptop computer from the fixture. As a result, a customer may not examine and/or may not utilize the laptop computer while the laptop computer is attached to and/or is connected to the fixture. Additionally, a length of the rod may be less than a length of the keyboard of the laptop computer. As a result, the rod may be incapable of extending across the keyboard of the laptop computer and/or may be incapable of securing the laptop computer to the fixture. Furthermore, the length of the rod may not be adjustable to receive and/or to secure computer laptops having different lengths.

A need, therefore, exists for a bracket, a system and a method for securing a portable electronic device to a fixture. Additionally, a need exists for a bracket, a system and a method for securing the device to the fixture to prevent the device from being separated from the fixture. Further, a need exists for a bracket, a system and a method for securing the device to the fixture which may provide a first shaft, a second shaft, a cable, a locking member, a first mount and/or a second mount for attaching and/or for connecting the device to the fixture. Still further, a need exists for a bracket, a system and a method for securing the device to the fixture which may allow the device to be lifted off a top surface of the fixture for examination while remaining connected, attached and/or secured to the fixture. Moreover, a need exists for a bracket, a system and a method for securing the device to the fixture which may have a first shaft with a length based on a length of the device. Furthermore, a need exists for a bracket, a system and a method for securing the device to the fixture which may have a cable for connecting, for securing and/or for attaching the device and/or the bracket to the fixture. Additionally, a need exists for a bracket, a system and a method for securing the device to the fixture which may have a pin extending outward with respect to the second arm and/or the first mount for attaching the bracket to the fixture via the cable.

SUMMARY OF THE INVENTION

The present invention generally relates to a bracket as well as a system and a method for securing a device to a fixture. More specifically, the present invention relates to an apparatus, a system and a method for securing a portable electronic device to a fixture. The apparatus may have a shaft, a bracket, a cable, a pin and/or a locking member. The bracket may be attached to the device and/or may be connected to the cable. The shaft, the pin and/or a shoulder may be located between the cable and the bracket and/or the device. The cable may be attached to the fixture. The locking member may secure the device to the cable and/or may attach the bracket to the cable via the second arm or the pin. As a result, the device and/or the bracket may be secured to the fixture.

INSERT To this end, in an embodiment of the present invention, a bracket for securing a device to a fixture wherein the device has a length defined between a first end and a second end wherein the device has a first part connected to a second part wherein the first part has a thickness is provided. The bracket has a first mount having a base with a top side and a bottom side wherein the bottom side is opposite to the top side and further wherein the base has a wall extending outward with respect to the top side. Further, the bracket has a second mount having a base with a top side and a bottom side wherein the bottom side is opposite to the top side and further wherein the base has a wall extending outward with respect to the top side wherein an aperture is formed in the wall of the first mount and the wall of the second mount wherein a location of the aperture in the wall of the first mount and in the wall of the second mount is based on the thickness of the first part of the device. Moreover, the bracket has a first shaft having a length defined between a first end and a second end wherein the first shaft is insertable into the aperture of the wall of the first mount and the aperture of the wall of the second mount wherein the first shaft connects the first mount and the second mount and a cable having a length defined between a first end and a second end wherein the first end of the cable is connectable to the first mount and the second mount.

In an embodiment, the bracket has a second shaft connecting the first mount and the second mount.

In an embodiment, the bracket has a shoulder attached to the wall of the first mount wherein the shoulder extends outward with respect to the base and further wherein the shoulder is connected to the cable.

In an embodiment, the bracket has a locking member connected to the cable wherein the locking member secures the cable to first mount and the second mount.

In an embodiment, the bracket has a connector attaching the cable to the first mount and the second mount wherein the connector is located between the first mount and the second mount.

In an embodiment, the length of the first shaft is based on the length of the device.

In an embodiment, the bracket has a coating on the base of the first mount and the second mount.

In an embodiment, the bracket has a hole formed in the base of the first mount and the second mount.

In another embodiment of the present invention, a system for securing a device to a fixture wherein the device has a length defined between a first end and a second end wherein the device has a first part connected to a second part wherein the first part has a thickness is provided. The system has a bracket having a length defined between a first mount and a second mount opposite to the first mount wherein the first mount and the second mount have an interior surface and an exterior surface wherein the bracket has a plurality of apertures extending from the interior surface through the bracket to the exterior surface. Further, the system has a first shaft having a length defined between a first end and a second end wherein the second end is opposite to the first end and further wherein the first shaft inserts into the aperture of the bracket wherein the first end of the first shaft extends outward with respect to the interior of the first mount wherein the second end of the first shaft inserts into the aperture of the second mount wherein the length of the base and the first shaft are based on the length of the device wherein the first part of the device inserts between the first shaft and the bracket wherein the second part of the device extends outward with respect to the bracket wherein the first shaft connects the device to the first mount and the second mount. Moreover, the system has a cable having a length defined between a first end and a second end wherein the cable connects the fixture to the first mount and the second mount.

In an embodiment, the first part of the device abuts the first shaft and the bracket.

In an embodiment, the system has a hole formed in the bracket wherein the first part of the device attaches to the bracket via the hole.

In an embodiment, the system has a second shaft insertable between the first mount and the second mount wherein the second shaft attaches the cable to the bracket.

In an embodiment, the system has a locking member connected to the bracket wherein the locking member secures the bracket and the cable.

In an embodiment, the system has a coating on the interior surface and the exterior surface of the first mount and the second mount.

In another embodiment of the present invention, a method for securing a device to a fixture wherein the device has a length defined between a first end and a second end wherein the device has a first part connected to a second part wherein the first part has a thickness is provided. The method has the step of providing a bracket having a first shaft connecting a first mount to a second mount wherein the second mount is in first position with respect to the first mount wherein the first mount and the second mount have a plurality of apertures wherein a location of one of the plurality of apertures in the first mount and in the second mount is based on the thickness of the first part of the device and further wherein the first shaft inserts into the one of the plurality of apertures of the first mount and the second mount. Further, the method has the step of moving the second mount to a second position with respect to the first mount wherein the second position is based on the length of the device. Moreover, the method has the step of connecting a locking member to the bracket wherein the locking member restricts the second mount from extending outward with respect to the first mount to a third position from the second position.

In an embodiment, the method has the step of inserting the device into the bracket.

In an embodiment, the method has the step of attaching the bracket to the fixture.

In an embodiment, the method has the step of connecting a cable between the fixture and the bracket.

In an embodiment, the method has the step of separating the device from the bracket.

In an embodiment, the method has the step of displaying the device on the fixture.

It is, therefore, an advantage of the present invention to provide a bracket, a system and a method for securing a device to a fixture to prevent theft of and/or destruction of the device.

Another advantage of the present invention is to provide a bracket, a system and a method for securing a device to a fixture which may prevent separation of the device from the fixture.

And, another advantage of the present invention is to provide a bracket, a system and a method for securing a device to a fixture which may be easy to assemble and/or may be easy to attach to the device.

Yet another advantage of the present invention is to provide a bracket, a system and a method for securing a device to a fixture which provides a first mount, a second mount, a pin and/or a shaft for attaching the device to the bracket and/or the fixture.

A further advantage of the present invention is to provide a bracket, a system and a method for securing a device to a fixture which provides a shaft, a cable, a pin and/or a locking member for attaching the bracket to the fixture.

Moreover, an advantage of the present invention is to provide a bracket, a system and a method for securing a device to a fixture which has a length which may be adjustable to and/or may be based on a length of the device.

And, another advantage of the present invention is to provide a bracket, a system and a method to secure a device to a fixture which receives the device between a shaft and a first mount and/or a second mount.

Yet another advantage of the present invention is to provide a bracket, a system and a method for securing a device to a fixture which provides a cable which may be movable between a pin or a first end and a second end of a shaft of the bracket.

Another advantage of the present invention is to provide a bracket, a system and a method for securing a device to a fixture which receives and/or attaches to devices having different lengths.

Yet another advantage of the present invention is to provide a bracket, a system and a method for securing a device to a fixture which provides a first shaft, a pin and/or a second shaft to secure the device to the bracket and/or the fixture.

A still further advantage of the present invention is to provide a bracket, a system and a method for securing a device to a fixture which receives and/or attaches to devices having different thicknesses.

Moreover, an advantage of the present invention is to provide a bracket, a system and a method for securing a device to a fixture which provides an opening in a first mount and/or in a second mount corresponding to thicknesses of the device.

And, another advantage of the present invention is to provide a bracket, a system and a method for securing a device to a fixture which provides openings in a first mount and/or a second mount based on a thicknesses of the devices.

Yet another advantage of the present invention is to provide a bracket, a system and a method for securing a device to a fixture which provides a coating on a first mount, a second mount, a first shaft and/or a second shaft to protect the device.

A further advantage of the present invention is to provide a bracket, a system and a method for securing a device to a fixture which provides a pin extending through a first mount, a shaft, and/or a shoulder for attaching the bracket to a cable and/or the fixture.

Moreover, an advantage of the present invention is to provide a bracket, a system and a method for securing a device to a fixture which provides a shaft having a plurality of holes corresponding to a length of more than one device.

And, another advantage of the present invention is to provide a bracket, a system and a method to secure a device to a fixture which provides a pin insertable into a connector and/or a locking member for attaching the bracket to a cable and/or the device.

Yet another advantage of the present invention is to provide a bracket, a system and a method for securing a device to a fixture which provides a pin insertable in a hole, a first mount, a shaft and/or a passage for attaching the bracket to a cable and/or the device.

Another advantage of the present invention is to provide a bracket, a system and a method for securing a device to a fixture which provides a pin having an end to engage a locking member to attach the bracket to a cable and/or the fixture.

Additional features and advantages of the present invention are described in, and will be apparent from, the detailed description of the presently preferred embodiments and from the drawings.

DETAILED DESCRIPTION OF THE PREFERRED EMBODIMENTS

The present invention generally relates to a bracket as well as a system and a method for securing a device to a fixture. The bracket may have a first mount, a second mount and/or a first arm for receiving and/or for securing the device to the bracket. A second arm may be attachable to the first mount and/or the second mount via an opening in the first mount and/or the second mount. A first end of a cable may be connectable and/or may be attachable to the second arm of the bracket. A second end of the cable may be attached to, may be connected to and/or may be secured to the fixture. As a result, the device and/or the bracket may be attached to, may be connected to and/or may be secured to the fixture via the cable. The first arm and/or the second arm may have a length which may be adjustable based on a length of the device. As a result, the bracket may attach to devices having more than one length. The first mount and/or the second mount may have apertures for receiving the first arm which may be based on a thickness of the device. As a result, the bracket may attach to devices having different thicknesses. Moreover, the first mount and/or the second mount may have a coating to protect the device.

Figure 1:
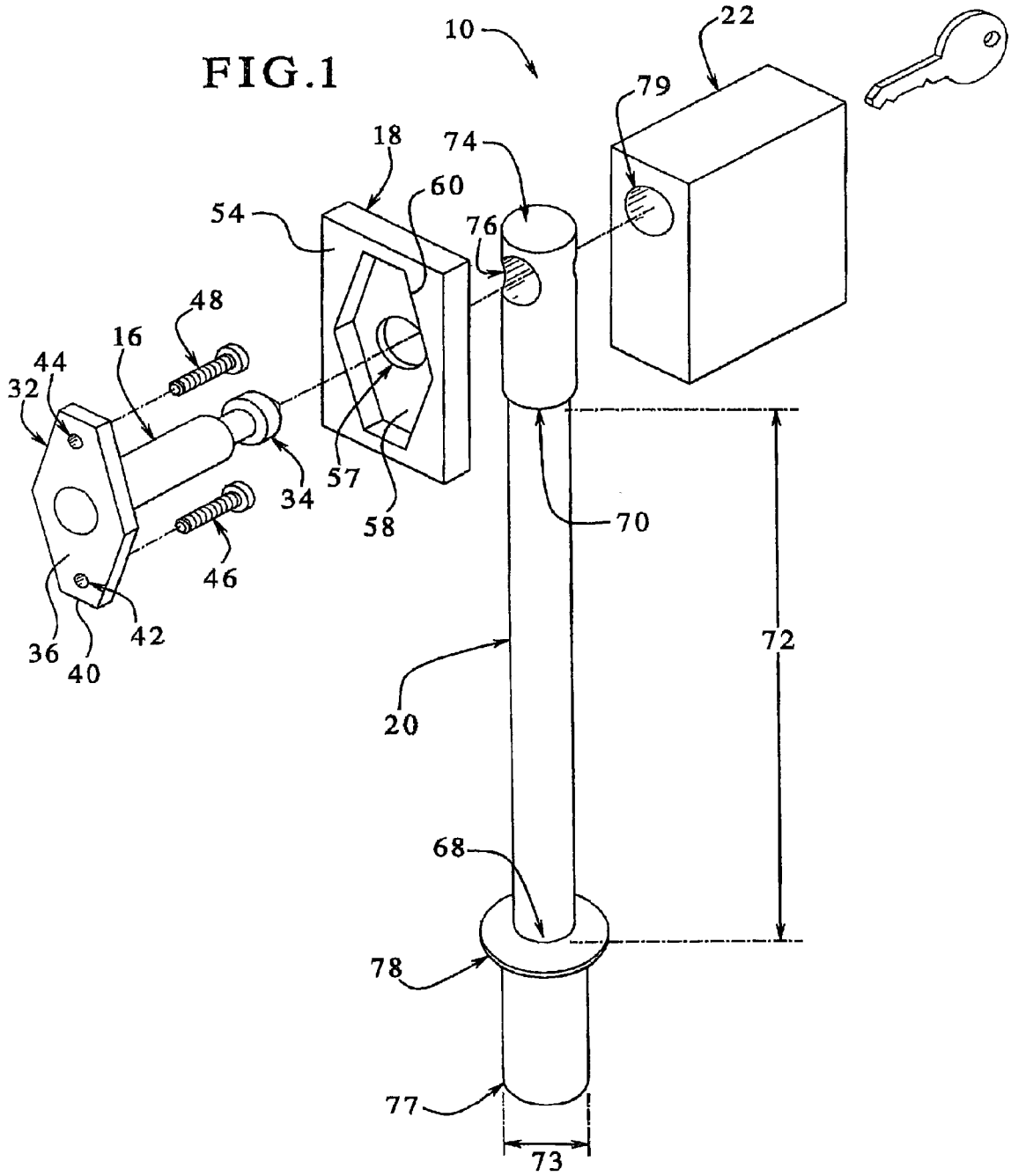
FIG. 1 is an exploded perspective view of an apparatus for securing a device to a fixture in an embodiment of the present invention.
Figure 2:
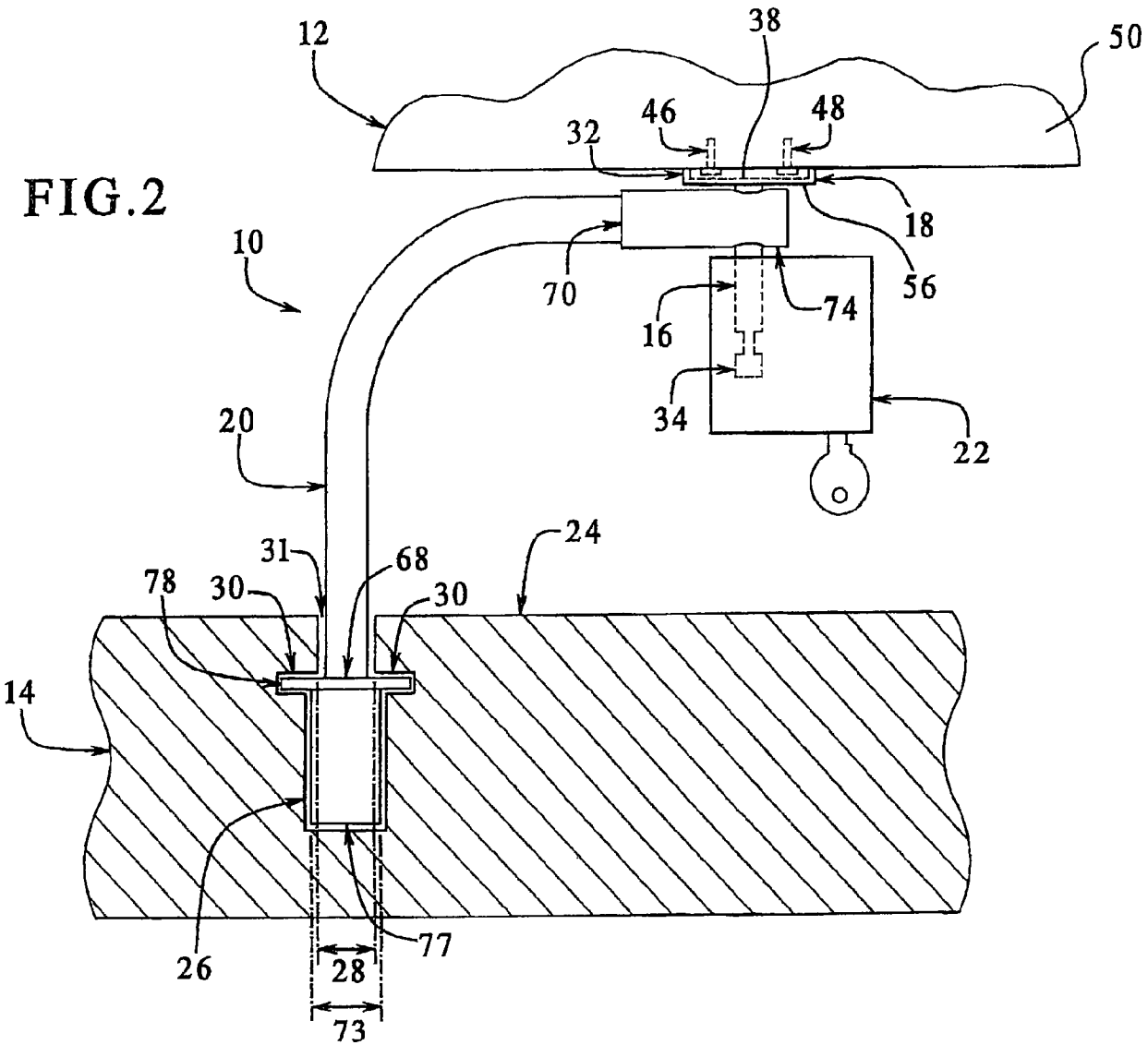
FIG. 2 is a side plan view of an apparatus for securing a device to a fixture in an embodiment of the present invention.

Referring now to the drawings wherein like numerals refer to like parts, FIGS. 1 and 2 illustrate an apparatus 10 which may secure a device 12 to a fixture 14 in an embodiment of the present invention. The apparatus 10 may have an arm 16, a housing 18, a cable 20, and/or a locking member 22. Further, the fixture 14 may have a top surface 24, a groove 26, a lip 30 and/or an opening 31. The opening 31 may have a diameter 28. The device 12 may be a portable device, such as, for example, a laptop computer, a cellular phone, a portable compact disc player, a portable MP3 player, a personal data assistant, a camera, a digital camera, a video recorder and/or the like. The fixture 14 may be, for example, a table, a shelf, a display unit and/or the like. The present invention should not be deemed as limited to a specific device 12 and/or a specific fixture 14. The arm 16 may have a bracket 32 and/or a tip 34 that may be opposite to the bracket 32. The bracket 32 may have a front side 36, a backside 38, a perimeter 40, a first mounting hole 42 and/or a second mounting hole 44. The first mounting hole 42 and/or the second mounting hole 44 may extend through the bracket 32 from the first side 36 to the backside 38 of the bracket 32.

A first connector 46 and/or a second connector 48 may be inserted into the first mounting hole 42 and/or the second mounting hole 44, respectively. The first connector 46 and/or the second connector 48 may extend outward with respect to the front side 36 of the bracket 32. The first connector 46 and/or the second connector 48 may attach the bracket 32 and/or the arm 16 to the device 12. The first connector 46 and/or the second connector 48 may attach to an exterior 50 of the device 12. The first connector 46 and/or the second connector 48 may be, for example, a screw, a bolt, a hook and/or the like. The arm 16 may be integrally formed with the bracket 32 and/or the tip 34. The arm 16, the bracket 32 and/or the tip 34 may be made from a material, such as, for example, steel and/or the like. The present invention should not be deemed as limited to a specific first connector 46 and/or a specific second connector 48 and/or a specific material of the arm 16, the bracket 32 and/or the tip 34.

As shown in FIGS. 1 and 2, the housing 18 may have a front side 54, a second side 56 and/or a passage 57. The front side 56 may have a recession 58 which may have a perimeter 60. The passage 57 may extend through the housing 18 from the front side 54 to the second side 56 of the housing 18. Further, the passage 57 may be located within the perimeter 60 of the recession 58. The tip 34 of the arm 16 may be inserted through the passage 57 of the housing 18. The tip 34 of the arm 16 may extend outward with respect to the second side 56 of the housing 18.

The perimeter 60 of the recession 58 may receive the perimeter 40 of the bracket 32. As a result, the bracket 32 may be inserted into the recession 58. The backside 38 of the bracket 32 may abut the first side 56 and/or the recession 58 of the housing 18. As a result, the bracket 32 may be enclosed between the housing 18 and the device 12. The housing 18 may cover the first connector 46 and/or the second connector 48. The housing 18 may prevent access to the first connector 46 and/or the second connector 48 As a result, the housing 18 may prevent the first connector 46 and/or the second connector 48 from being removed from the bracket 32 and/or the device 12. The housing 18 may be made from a material, such as, for example, steel and/or the like. The present invention should not be deemed as limited to a specific material of the housing 18.

A cable 20 may have a first end 68, a second end 70 and/or a length 72, as illustrated in FIGS. 1 and 2. The second end 70 may be attached to a head 74 with an opening 76. The opening 76 may extend through the head 74. The first end 68 may be attached to a stopper 77 with a diameter 73 and/or a shoulder 78. The cable 20 may be made from a material, such as, for example, steel, galvanized steel and/or the like. The length 72 of the cable 20 may be, for example, six inches, twelve inches or eighteen inches. The head 74, the shoulder 78 and the stopper 77 may be made from a material, such as, for example, steel and/or the like. The present invention should not be deemed as limited to a specific material of the cable 20, the head 74, the shoulder 78 and/or the stopper 77, a specific length of the cable 20 and/or a specific diameter of the shoulder 78.

As illustrated in FIG. 2, the shoulder 78 and/or the stopper 77 may be inserted into the groove 26, the opening 31 and/or the lip 30 of the fixture 14. The diameter 28 of the opening 31 may be less than the diameter 73 of the stopper 77. As a result, the opening 31 may prevent the shoulder 78 and/or the stopper 77 from being removed therefrom. The shoulder 78 may be adjacent to the lip 30 and/or the opening 31. As a result, the stopper 77 and/or the shoulder 78 may be secured to the fixture 14 via the lip 30 and/or the opening 31 of the fixture 14. Further, the cable 20 may be attached to the fixture 14 via the stopper 77, the groove 26, the lip 30 and/or the opening 31 of the fixture 14. Moreover, the cable 20 may extend outward with respect to the top surface 24 and/or the opening 31 of the fixture 14.

The tip 34 of the arm 16 may be inserted through the opening 76 of the head 74 as illustrated in FIGS. 1 and 2. As a result, the second side 56 of the housing 18 may be adjacent to the opening 76 and/or the head 74. The tip 34 of the arm 16 may extend outward with respect to the head 74. Further, the device 12, the arm 16, the bracket 32 and/or the housing 18 may be connected to the cable 20, the head 74, the stopper 77 and/or the fixture 14 via the opening 76 of the head 74. Still further, the tip 34 of the arm 16 may be inserted into a lock hole 79 of the locking member 22. The locking member 22 may be a lock, such as, for example, a padlock, a lock having a key 81, a combination lock and/or the like. The locking member 22 may be engaged by, for example, turning the key 81 and removing the key 81 from the locking member 22. The tip 34 of the arm 16 may be locked inside the lock hole 79 of the locking member 22. As a result, the device 12 and/or the arm 16 may be secured to the locking member 22. Moreover, the device 12 may be attached to and/or may be secured to the cable 20, the head 74, the bracket 32, the arm 16, the locking member 22 and/or the fixture 14. It should be understood that the locking member 22 may be any lock that may be implemented by one having ordinary skill in the art. The present invention should not be deemed as limited to the embodiment of a specific locking member.

A user (not shown in the drawings) may connect the device 12 to the apparatus 10 and/or the fixture 14. The user may attach and/or may lock the device 12 to the apparatus 10 via the arm 16 and/or the locking member 22. Further, the user may attach the apparatus 10 and/or the device 12 to the fixture 14 via the cable 20 and the opening 31 of the fixture 14. As a result, the user may secure the device 12 to the fixture 14. Still further, the user may detach the locking member 22 and/or the device 12 from the apparatus 10. The user may be an employee of an entity (not shown in the drawings), such as, for example, a vendor, a wholesaler and/or a retailer. The entity may sell portable electronic devices, such as, the device 12. Moreover, the user may use the apparatus 10 and/or the fixture 14 to display and/or to exhibit the device 12. The present invention should not be deemed as limited to the embodiment of a specific entity.

A person (not shown in the drawings) may manipulate, may examine and/or may utilize the device 12 without detaching the device 12 from the fixture 14. The apparatus 10 may allow the person to lift the device 12 from the top surface 24 of the fixture 14 while the device 12 remains attached to the fixture 14 via the cable 20 and/or the locking member 22. Further, the apparatus 10 may allow the person to examine physical characteristics, such as, for example, weight, appearance and/or texture of the device 12 while the device 12 remains secured to the fixture 14. The present invention should not be deemed as limited to the embodiment of a specific person.

Figure 3:
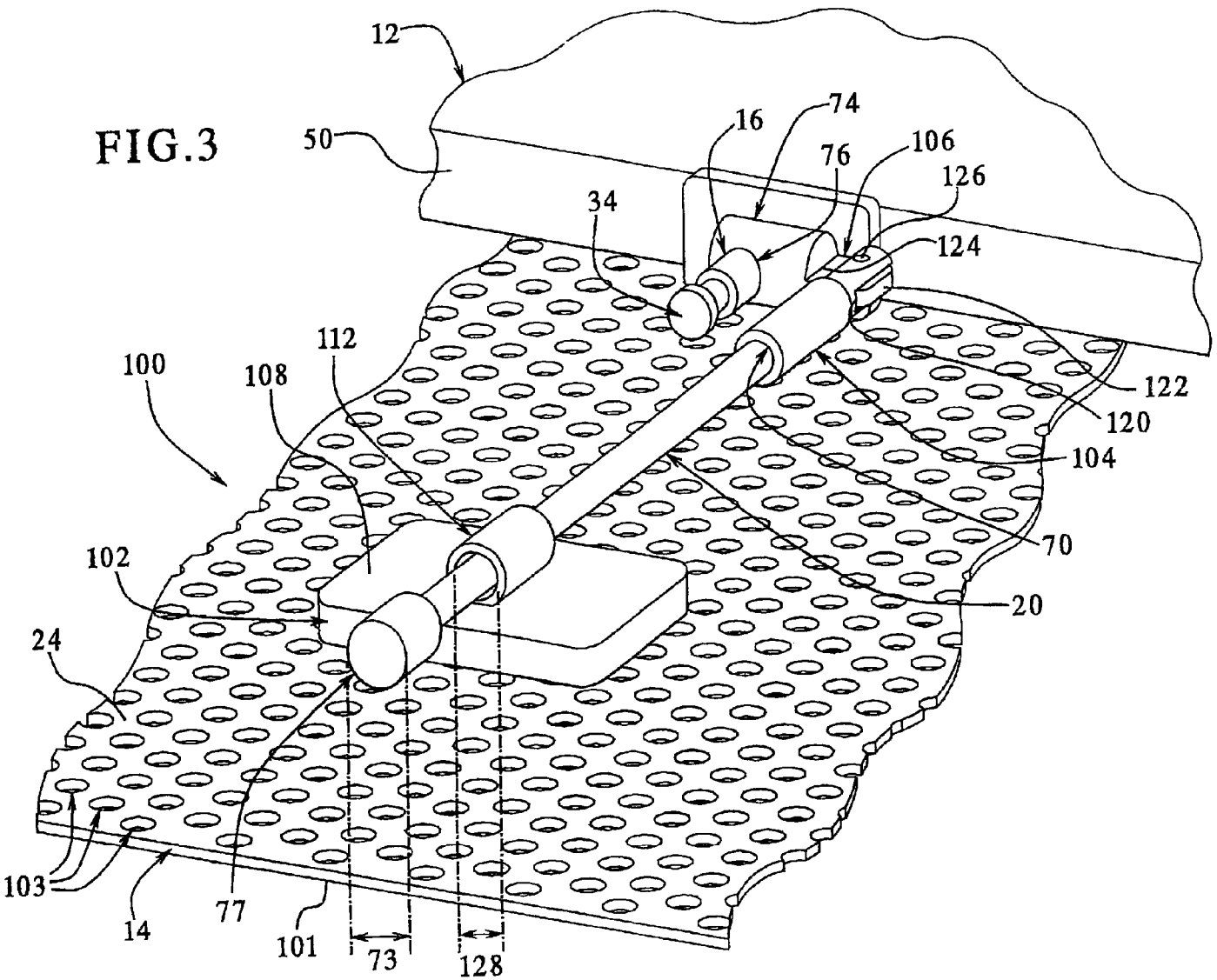
FIG. 3 is a perspective view of an apparatus for securing a device to a fixture in an embodiment of the present invention.

As illustrated in FIG. 3, an apparatus 100 may secure the device 12 to the fixture 14 in another embodiment of the present invention. The apparatus 100 may have a base 102, a support 104 and/or a leg 106. The fixture 14 may have a bottom surface 101 and/or a plurality of holes 103. Each of the plurality of holes 103 may extend through the fixture 14 from the bottom surface 101 to the top surface 24 of the fixture 14.

Figure 5:
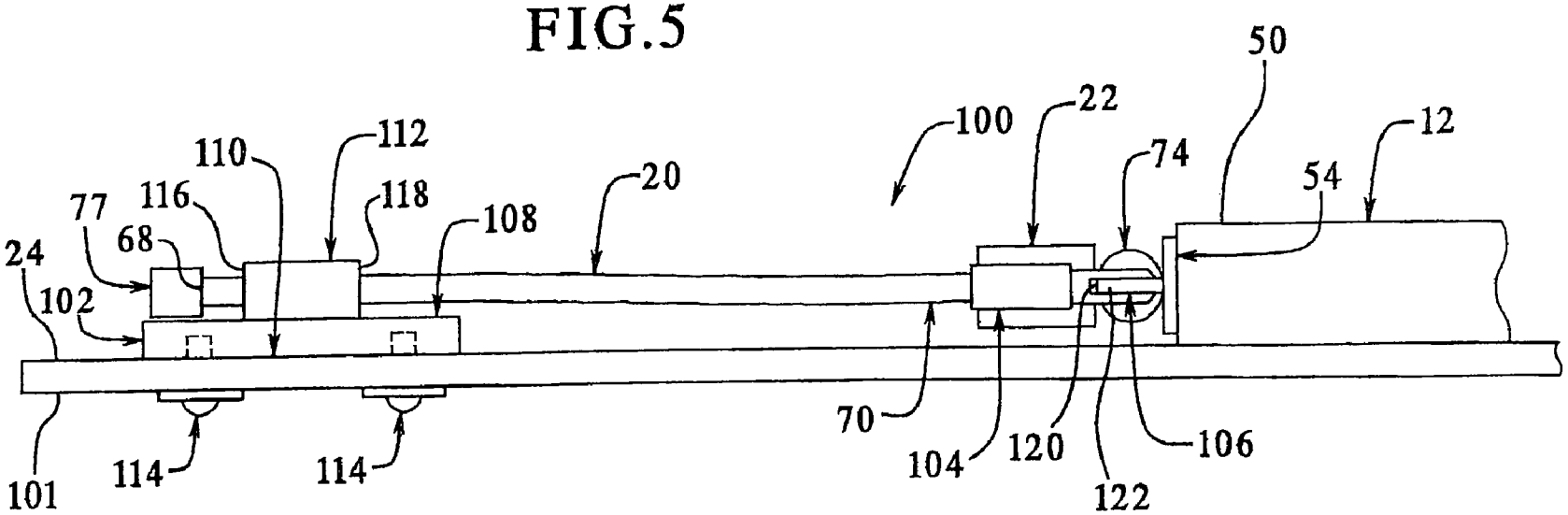
FIG. 5 is a side plan view of an apparatus for securing a device to a fixture in an embodiment of the present invention.

As illustrated in FIG. 5, the base 102 may have a top side 108 and/or a bottom side 110. The top side 108 may have a sleeve 112 located thereon. The base 102 may be integrally formed with the sleeve 112 having a diameter 128 which may be equal to the diameter 28. The base 102 may be made from a material, such as, for example, steel and/or the like. Moreover, the present invention should not be deemed as limited to a specific material of the base 102.

The base 102 may be connected to the fixture 14 via mounts 114. Each one of the mounts 114 may be inserted into a respective one of the holes 103 of the fixture 14. Each one of the mounts 114 may extend outward with respect to the top surface 24 of the fixture 14. Each of the mounts 114 may attach to the bottom side 110 of the base 102. As a result, the base 102 may be attached to the fixture 14. The bottom side 110 of the base 102 may be adjacent to the top surface 24 of the fixture 14. Each of the mounts 114 may be made from a material, such as, steel and/or the like. The present invention should not be deemed as limited to a specific material of each of the plurality of mounts 114.

The support 104 may be attached to the second end 70 of the cable 20 as shown in FIG. 3. The support 104 may have a slot 120 therein. The leg 106 may have a first end 122 and/or a second end 124. The first end 122 of the leg 106 may be inserted into the slot 120 in the support 104. A pin 126 may be inserted into the support 104 and/or through the first end 122 of the leg 106. As a result, the first end 122 of the leg 106 may be attached to the support 104 via the slot 120 and/or the pin 126. The leg 106 may, for example, extend outward with respect to the slot 120 of the support 104.

Figure 4:
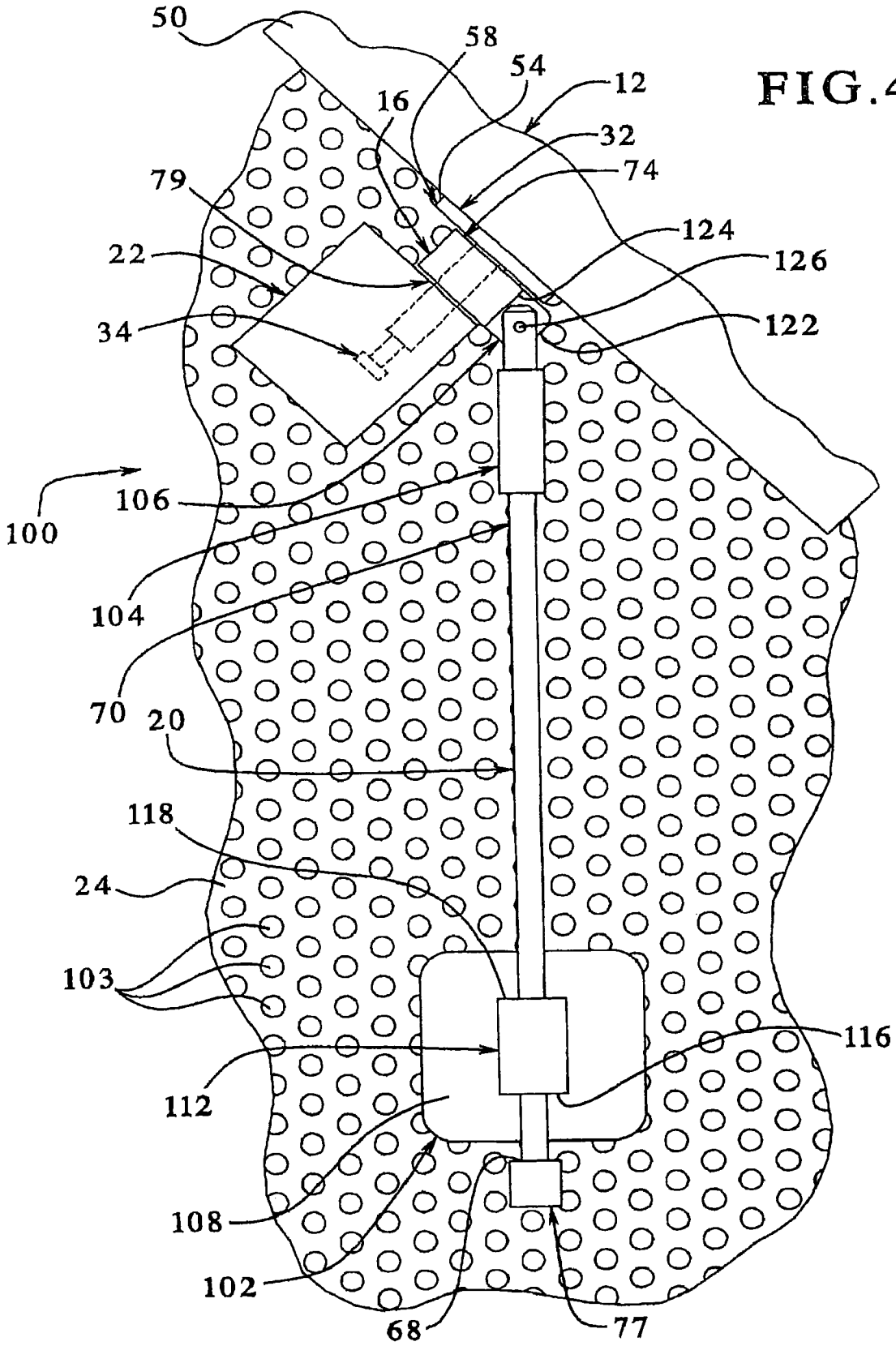
FIG. 4 is a top plan view of an apparatus for securing a device to a fixture in an embodiment of the present invention.

As illustrated in FIGS. 3 and 4, the slot 120 and/or the pin 126 may allow the second end 124 of the leg 106 to rotate with respect to the support 104 and/or the cable 20. The head 74 may be attached to the second end 124 of the leg 106. The pin 126, the leg 106 and/or the slot 120 may allow the head 74 to rotate with respect to the support 104 and/or the cable 20. The leg 106 and/or the head 74 may be rotated by a degree, such as, for example, thirty degrees, forty-five degrees or ninety degrees. The support 104 and/or the leg 106 may be made from a material, such as, for example, steel and/or the like. The present invention should not be deemed as limited to a specific degree of rotation by the leg 106 and/or a specific material of the support 104 and/or the leg 106.

The sleeve 112 of the base 102 may have a first end 116 and/or a second end 118 as shown in FIG. 5. The second end 70 of the cable 20, the support 104, the leg 106 and/or the head 74 may be inserted into the first end 116 of the sleeve 112. The cable 20 may extend through the sleeve 112 from the first end 116 to the second end 118 of the sleeve 112. The second end 70, the support 104, the leg 106 and/or the head 74 of the cable 20 may extend outward with respect to the second end 118 of the sleeve 112. As a result, the stopper 77 and/or the first end 68 of the cable 20 may be adjacent to the base 102 and/or the first end 116 of the sleeve 112. The length 72 of the cable may allow the support 104 and/or the head 74 to move inward and/or outward with respect to the second end 118 of the sleeve 112 and/or the base 102. The diameter 73 of the stopper 77 may be greater than the diameter 128 of the sleeve 112. As a result, the sleeve 112 and/or the stopper 77 may prevent the first end 68 of the cable 20 from passing through the sleeve 112 from the first end 116 to the second end 118 of the sleeve 112.

The device 12 may be attached to the arm 16 via the bracket 32 as shown in FIG. 4. The arm 16 may be inserted through the passage 57 of the housing 18. The front side 54 and/or the recession 58 of the housing 18 may be adjacent to the device 12 and/or the bracket 32 of the arm 16. Further, the tip 34 of the arm 16 may extend outward with respect to the device 12 and/or the housing 18. Still further, the tip 34 of the arm 16 may be inserted through the opening 76 of the head 74 as shown in FIG. 3. Moreover, the tip 34 may be inserted into the lock hole 79 of the locking member 22. The tip 34 may be locked into the locking member 22. The device 12 may be attached to the locking member 22, the head 74, the leg 106, the support 104, the cable 20 and the base 102 via the sleeve 112. As a result, the device 12 may be secured to the fixture 14.

The user may use the apparatus 100 to secure and/or to attach the device 12 to the fixture 14. Further, the user may attach and/or may lock the device 12 to the apparatus 100 via the arm 16 and/or the locking member 22. Still further, the user may attach the apparatus 100 and/or the device 12 to the fixture 14 via the cable 20, the base 102, the sleeve 112 of the base 102, the mounts 114 and/or the holes 103 in the fixture 14. Moreover, the user may detach the locking member 22, the device 12 and/or the apparatus 100 from the fixture 14.

The user may utilize the apparatus 100 to manipulate, to examine and/or to utilize the device 12 without detaching the device 12 from the fixture 14. Further, the apparatus 100 may allow the user to lift the device 12 from the top surface 24 of the fixture 14 while the device 12 remains attached to the fixture 14 via the cable 20. Still further, the apparatus 10 may allow the person to examine the physical characteristics of the device 12 while the device 12 remains secured to the fixture 14 via the cable 20.

Figure 6:
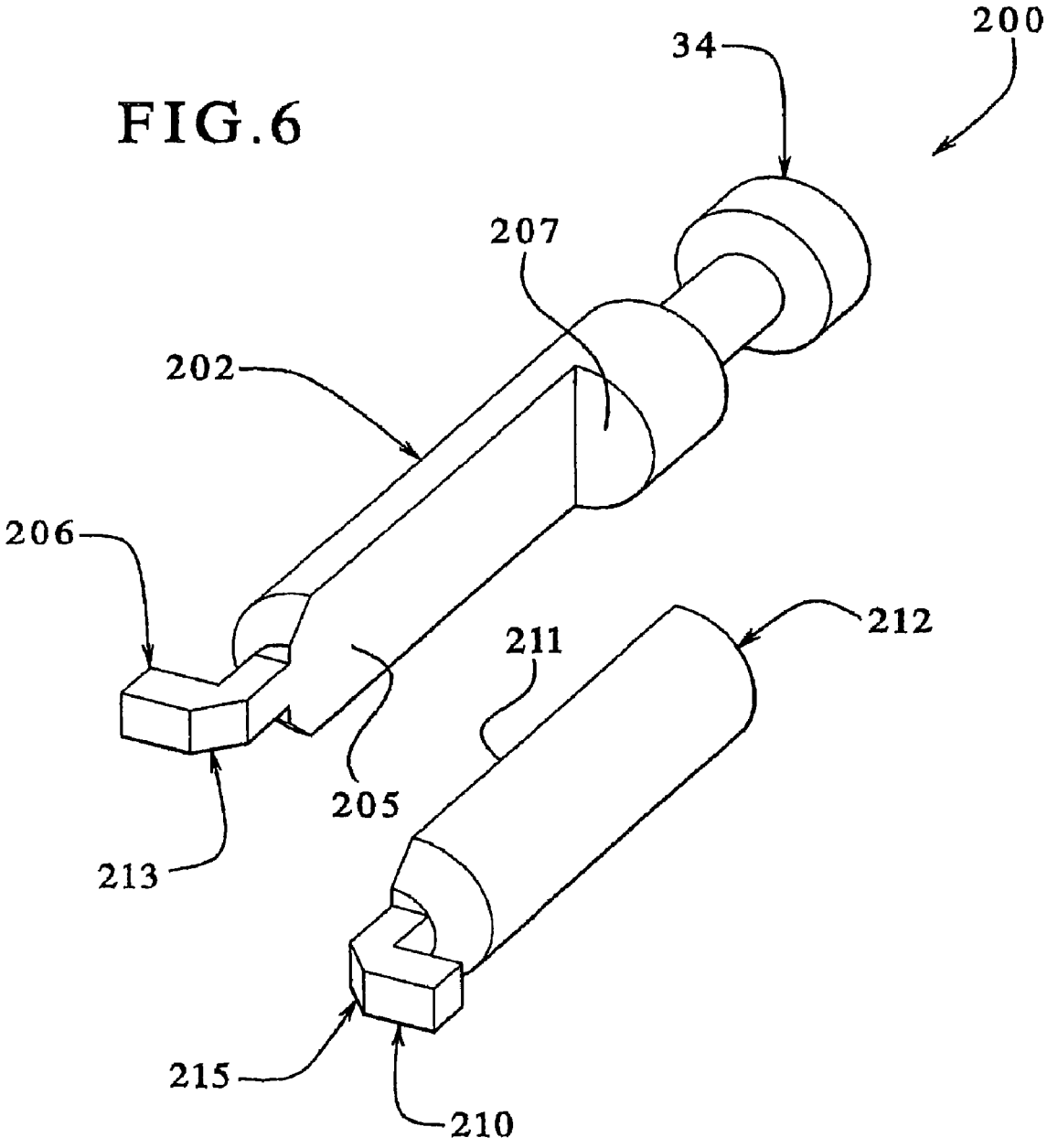
FIG. 6 is a perspective view of an anchor assembly for securing a device to a fixture in an embodiment of the present invention.

FIG. 6 illustrates an anchor assembly 200 which may secure the device 12 to the fixture 14 in an embodiment of the present invention. The anchor 200 may have a first finger 202 and/or a second finger 204. The first finger 202 may have a first hook 206, a first surface 205, a second surface 207, a first chamfer 213 and/or the tip 34. The second finger 204 may have a second hook 210, a surface 211, a second chamfer 215 and/or an end 212. The end 212 may be opposite to the second hook 210. The second finger 204 may align with the first finger 202 to form the anchor assembly 200. The surface 211 of the second finger 212 may abut the first surface 205 of the first finger 202. The end 212 of the second finger 204 may abut the second surface 207 of the first finger 202. The user may combine the first finger 202 with the second finger 204 to form the anchor assembly 200. The first finger 202 and/or the second finger 204 may be made from a material, such as, for example, steel and/or the like. The present invention should not be deemed as limited to a specific material of the first finger 202 and/or the second finger 204.

Figure 7:
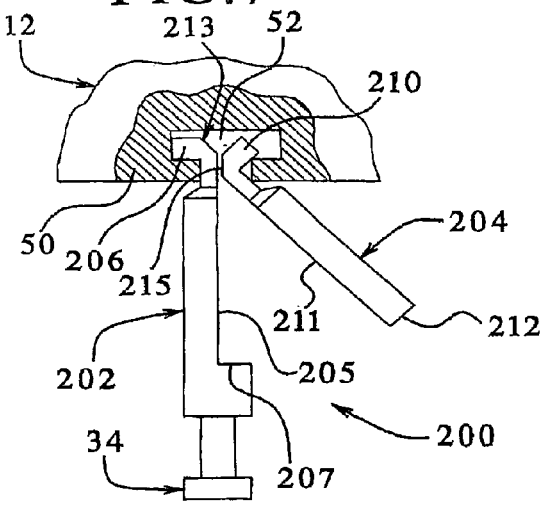
FIG. 7 is a top plan view of an anchor assembly being inserted into a port of a device in an embodiment of the present invention.

As illustrated in FIG. 7, the first hook 206 of the first finger 202 may be inserted into a port 52 on the exterior 50 of the device 12. The second hook 210 of the second finger 204 may be inserted into the port 52 of the device 12. The second chamfer 215 of the second finger 204 may allow the second hook 210 of the second finger 204 to enter the port 52. The second chamfer 215 of the second finger 204 may be adjacent to the first hook 206 of the first finger 202. The tip 34 may extend outward with respect to the port 52 of the device 12.

Figure 8:
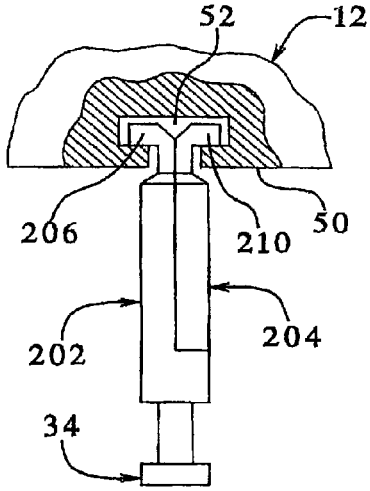
FIG. 8 is a top plan view of an anchor assembly attached to a device in an embodiment of the present invention.

As illustrated in FIG. 8, the first finger 202 and the second finger 204 may form the anchor 200. The second finger 204 may be pushed inward with respect to the first finger 202 by the user. The surface 211 of the second finger 204 may abut the first surface 205 of the first finger 202. The end 212 of the second finger 204 may abut the second surface 207 of the first finger 204. The first finger 202 may combine with the second finger 204 to form the anchor assembly 200. As a result, the anchor assembly 200 may be attached to the device 12 via the port 54 of the device 12.

Figure 9:
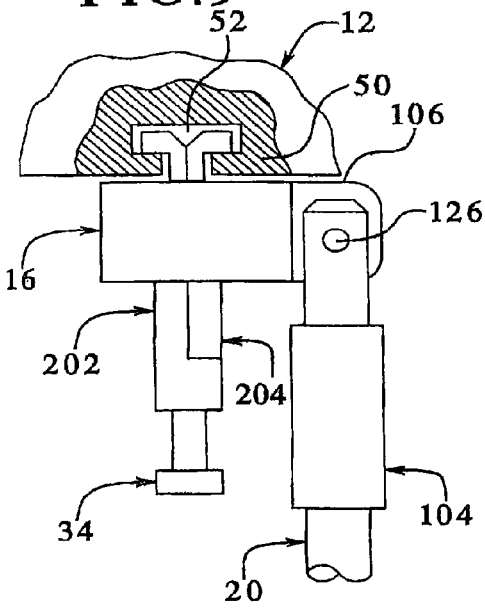
FIG. 9 is a top plan view of an apparatus for securing a device to a fixture in an embodiment of the present invention.

As illustrated in FIG. 9, the anchor assembly 200 may be inserted into the opening 76 of the head 74. The tip 34 of the first finger 202 may be inserted into the opening 76 of the head 74. The head 74 may be adjacent to the first hook 206, the second hook 210, the port 54 and/or the device 12. As a result, the tip 34 of the first finger 202 may extend outward with respect to the head 74 and/or the device 12.

Figure 10:
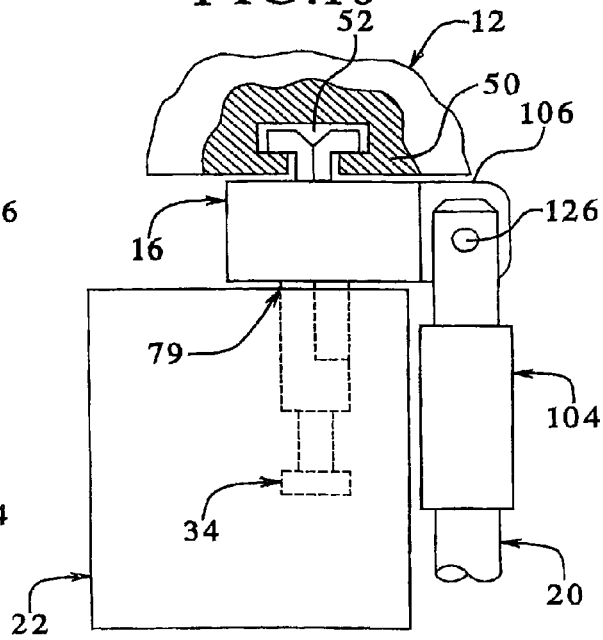
FIG. 10 is a top plan view of an apparatus securing a device to a fixture in an embodiment of the present invention.

As illustrated in FIG. 10, the anchor assembly 200 may be inserted into the lock hole 79 of the locking member 22. The tip 34 of the first finger 202 may be inserted into the lock hole 79 of the locking member 22. The tip 34 may be locked into the locking member 22. As a result, the anchor assembly 200 may be locked into the locking member 22. The device 12 may be locked to the head 74 via the locking member 22. As a result, the device 12 may be attached to the fixture 14, the base 102 or the opening 31 in the fixture 14 via the cable 20 and/or the stopper 77. Moreover, the device 12 may be secured to the fixture 14 via the anchor assembly 200, the locking member 22, the head 74, the cable 20 and/or the stopper 77.

The apparatus 10 and/or the apparatus 100 may secure and/or may attach the device 12 to the fixture 14. The anchor assembly 200 or the first connector 46 and/or the second connector 48 may attach the device 12 to the head 74, the cable 20 and/or the fixture 14. The first connector 46 and/or the second connector 48 may attach the device 12 to the bracket 32 of the arm 16. The tip 34 of the arm 16 or of the first finger 202 may pass through the head 74 via the opening 76 of the head 74. The tip 34 may be inserted into the lock hole 79 and/or locked into the locking member 22. The head 74 may be attached to the fixture 14 via the cable 20. As a result, the device 12 may be attached to and/or may be secured to the fixture 14.

Figure 11:
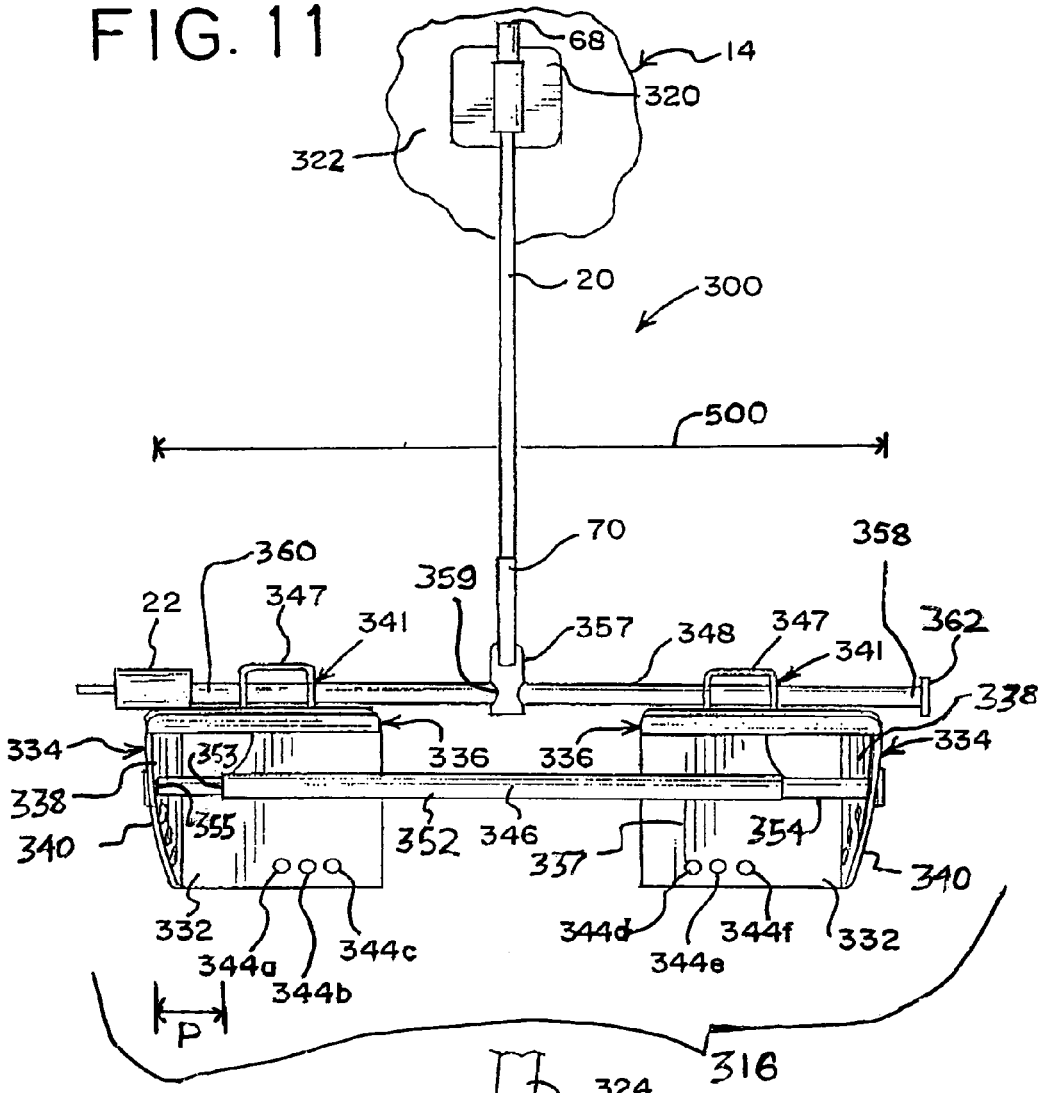
FIG. 11 illustrates a top plan view of a bracket for securing a device to a fixture in an embodiment of the present invention.
Figure 12:
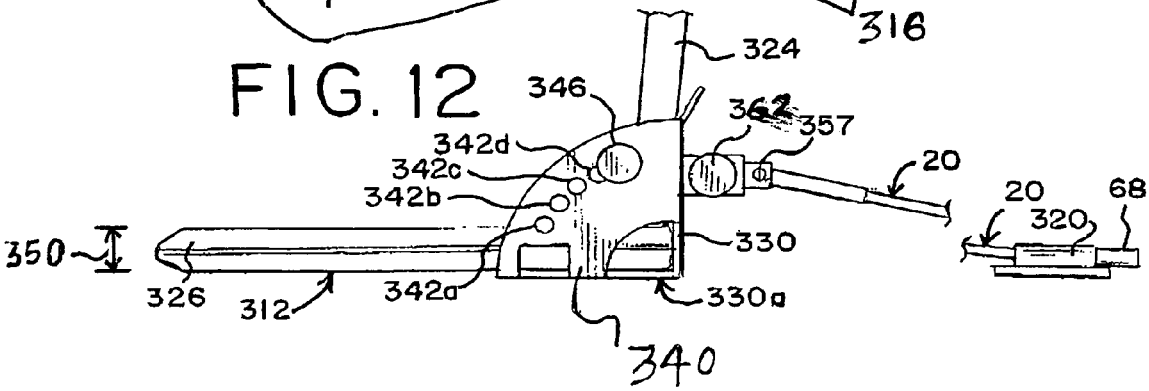
FIG. 12 illustrates a side plan view of a bracket for securing a device to a fixture in an embodiment of the present invention.
Figure 13:
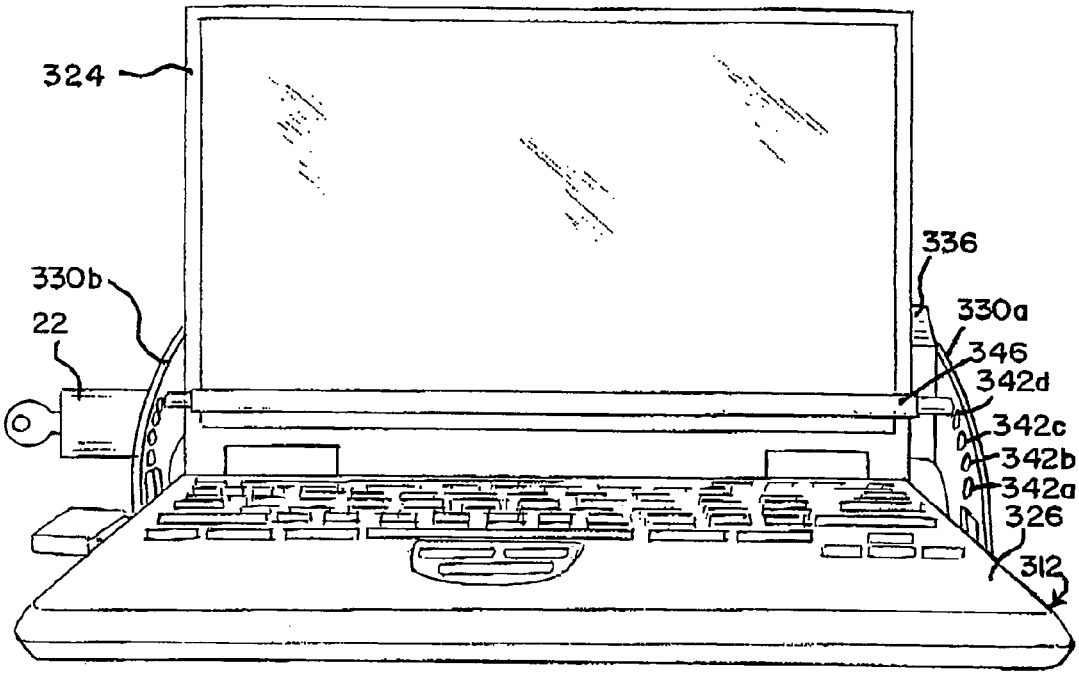
FIG. 13 illustrates a top plan view of a bracket for securing a device to a fixture in an embodiment of the present invention.
Figure 14:
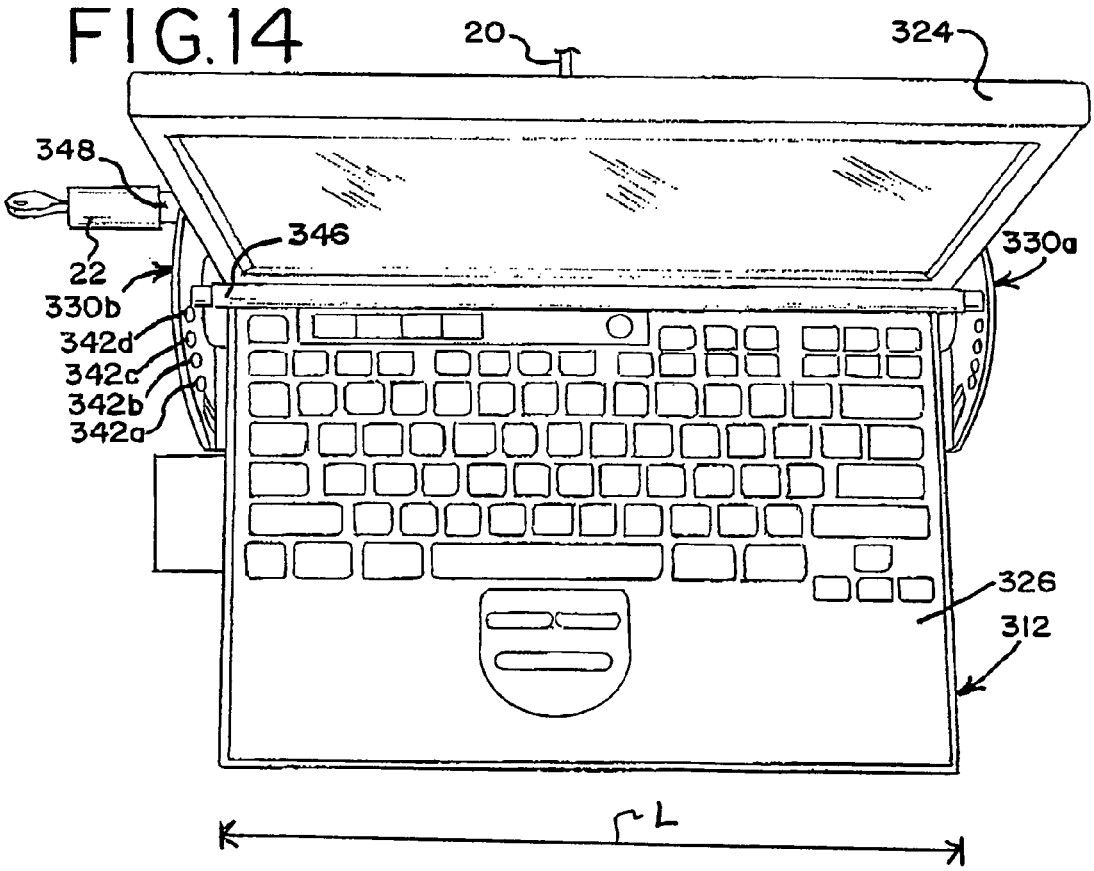
FIG. 14 illustrates a cross-sectional view of a device attached to the bracket and/or the fixture in FIG. 1 as taken along line I-I in an embodiment of the present invention.

FIGS. 11-13 illustrate a system 300 which may attach, may connect and/or may secure a portable electronic device 312 (hereinafter "the device 312") to the fixture 14 in an embodiment of the present invention. The system 300 may have a bracket 316, a cable 20 and/or a base 320. Further, the fixture 14 may have a top surface 322 as illustrated in FIG. 11. A first part 324 of the device 312 may separate from a second part 326 of the device 312 via a pivot 328. As a result, the device 312 may be opened via the pivot 328. The device 312 may be, for example, a laptop computer, a cellular phone, a portable compact disc player and/or the like. The first part 324 may be, for example, a display unit, a monitor and/or the like. The second part 326 of the device 312 may be, for example, an input unit, a keyboard and/or the like. The present invention should not be deemed as limited to a specific embodiment of the device 312, of the first part 324 and/or of the second part 326. It should be understood that the device 312 may be any device which may be opened by separating the first part 324 from the second part 326 at the pivot 328 as known by one of ordinary skill in the art.

The bracket 316 may have a first mount 330*a* and/or a second mount 330*b*. The mounts 330*a*, 330*b* may have a base 332, a first wall 334 and/or a second wall 336 as illustrated in FIGS. 11 and 12. The mounts 330*a*, 330*b* may have an interior surfaces 338 and/or an exterior surface 340. The mounts 330*a*, 330*b* may be made from a material, such as, for example, steel, stainless steel, sheet metal, cast iron and/or the like. The base 332, the first wall 334 and/or the second wall 336 of the mounts 330*a*, 330*b* may have a coating 337 on the interior surface 338 and/or the exterior surface 340. The coating 337 may prevent the device 312 from being damaged from the interior surface 338 and/or the exterior surface 340 of the mounts 330*a*, 330*b*. The coating 337 may be a material, such as, for example, rubber, latex and/or the like. The present invention should not be limited to a specific embodiment of the material of the mounts 330*a*, 330*b* and/or of the material of the coating 337. It should be understood that the material of the mounts 330*a*, 330*b* and/or of the coating 337 may be any material as known to one of ordinary skill in the art.

The first wall 334 of the mounts 330*a*, 330*b* may have apertures 342*a*-342*e* which may extend from the interior surface 338 through the mounts 330*a*, 330*b* to the exterior surface 340. The base 332 of the mounts 330*a*, 330*b* may have holes 344*a*-344*f* which may extend from the interior surface 338 through the mounts 330*a*, 330*b* to the exterior surface 340. The apertures 342*a*-342*e* and/or the holes 344*a*-344*f* may have a shape, such as, for example, circular, oval, square and/or the like. The second walls 336 of the mounts 330*a*, 330*b* may have a shoulder 347. The shoulder 347 may extend outward with respect to the exterior surface 340 of the mounts 330*a*, 330*b*. The shoulder 347 may have a passage 341 which may extend through the shoulder 347 of the mounts 330*a*, 330*b*. The present invention should not be limited to a specific embodiment of the shape of the apertures 342*a*-342*e* and/or the holes 344*a*-344*f* of the mounts 330*a*, 330*b*. It should be understood the number of the apertures 342*a*-342*e* and/or the number of the holes 344*a*-344*f* may be any number as known to one of ordinary skill in the art.

The system 300 may have a first shaft 346, a second shaft 348 and/or the locking member 22. The first shaft 346 may be insertable into one of the apertures 342*a*-342*e* of the first mount 330*a* and into a corresponding one of the apertures 342*a*-342*e* of the second mount 330*b*. For example, the first shaft 346 may be insertable into the aperture 342*a* of the mounts 330*a*, 330*b*. The first shaft 346 may be attached to, may be connected to and/or may be secured to the mounts 330*a*, 330*b* via one of the apertures 342*a*-342*e*. As a result, the first mount 330*a* may be attached to, may be connected to and/or may be secured to the second mount 330*b* via the first shaft 346. Each of the apertures 342*a*-342*e* may correspond to a thickness 350 of the second part 326 of the device 312. In an embodiment, the apertures 342*a* of the mounts 330*a*, 330*b* may correspond to the thickness 350 which may be one-half inch. In another embodiment, the apertures 342*b* of the mounts 330*a*, 330*b* may correspond to the thickness 350 which may be two-thirds of an inch. In yet another embodiment, the apertures 342*c* of the mounts 330*a*, 330*b* may correspond to the thickness 350 which may be three-fourths of an inch. The present invention should not be limited to a specific embodiment of the thickness 350 of the device 312.

The first shaft 346 may have a first part 352 with a first end 353 and/or a second part 354 with a second end 355. The second part 354 may be insertable into an interior (not shown in the drawings) of the first part 352. The second end 355 of the second part 354 may be movable inward or may be movable outward to a position P with respect to the first end 353 of the first part 352. As a result, the first mount 330*a* may move inward or may move outward based on and/or corresponding to a length L of the device 312 and/or the position P of the second part 354. The first position P of the second end 355 may correspond to and/or may be based on the length L of the device 312. As a result, the first shaft 346 may be adjusted to and/or may be moved to the length L of the device 312. For example, the first position P may correspond to the length L of the device 312 which may be in a range between, for example, twelve inches and twenty-one inches. The first shaft 346 and/or the second shaft 348 may have the coating 337. The coating 337 may prevent the device 312 from being damaged from the first shaft 346 and/or the second shaft 348. It should be understood that the present invention should not be limited to a specific embodiment of the length L of the device 312 and/or the range of the first shaft 346.

The second part 326 of the device 312 may be inserted and/or may be located between the first shaft 346 and the base 332 and/or the second wall 336 of the mounts 330*a*, 330*b*. The first part 324 of the device 312 may be located between the second wall 336 and the first shaft 346. Further, the first part 324 may extend outward with respect to the second wall 336 and/or the base 332 of the mounts 330*a*, 330*b*. The first shaft 346 and the mounts 330*a*, 330*b* may be sized to receive the device 312 based on the thickness 350 of the second part 326 and/or the length L of the device 312. The first shaft 346 may be inserted into one of the apertures 342*a*-342*e* which may correspond to and/or may be based on the thickness 350 of the second part 326 of the device 312. The second end 355 of the second part 354 may be moved to the position P which may correspond to the length L of the device. The first shaft 346 may be adjacent to, may be contacting and/or may be abutting the second part 326 of the device 312. The interior surface 338 of the mounts 330*a*, 330*b* may be adjacent to, may be contacting and/or may be abutting the second part 326 of the device 312. As a result, the second part 326 of the device 312 may be attached to, may be secured to and/or may be connected to the mounts 330*a*, 330*b* via the interior surface 338 of the mounts 330*a*, 330*b* and the first shaft 346.

The holes 344*a*-344*f* of the base 332 of the mounts 330*a*, 330*b* may correspond to holes (not shown in the drawings) on a bottom 356 of the second part 326 of the device 312. Fasteners (not shown in the drawings) may be inserted into the holes 344*a*-334*f* of the mounts 330*a*, 330*b* and/or the holes in the bottom 356 of the device 312. As a result, the device 312 may be attached to, may be connected to and/or may be secured to the mounts 330*a*, 330*b* via the fasteners. It should be understood that the fasteners may be any fastener capable of attaching, of securing and/or of connecting the device 312 to the mounts 330*a*, 330*b* as known by one of ordinary skill in the art.

The cable 20 may have the first end 68 and the second end 70. The first end 68 may be attached to and/or may be connected to the base 320. The base 320 may be attached to, may be connected to, may be fastened to and/or may be secured to the top surface 322 of the fixture 14. As a result, the cable 20 may be connected to, may be attached to and/or may be secured to the fixture 14. The second end 70 may have a connector 357 with an orifice 359 which may extend through the connector 357 for connecting the cable and/or the fixture to the bracket 316. The orifice 359 may be sized to receive the second shaft 348.

The second shaft 348 may have a first end 358 and a second end 360. The first end 358 may have a stopper 362. The second end 360 may have a notch (not shown in the drawings) for inserting into the locking member 22. The second shaft 348 may be a material, such as, for example, brass, steel, iron and/or the like. It should be understood that the material of the second shaft 348 may be any material as known by one of ordinary skill in the art.

The second end 360 of the second shaft 348 may be inserted into the passage 341 of the shoulder 347 of the first mount 330*a*. The stopper 362 may be adjacent to and/or may abut the shoulder 347 of the first mount 330*a*. The second end 360 may extend inward with respect to the shoulder 347 of the second mount 330*b*. The second end 360 may be inserted into the orifice 359 of the connector 357 of the cable 20. The cable 20 may extend through the orifice 359 of the connector 357 and/or inward with respect to the passage 341 of the shoulder 347 of the second mount 330*b*. The second end 360 of the second shaft 348 may be inserted into the passage 341 of the shoulder 347 of the second mount 330*b*. The second end 360 of the second shaft 348 may extend outward with respect to the shoulder 347 and/or may extend inward with respect to the first wall 334 of the second mount 330*b*.

The connector 357 may be located between and/or connected to the shoulder 347 of the mounts 330*a*, 330*b* via the second shaft 348. The second end 360 may be inserted into the locking member 22. The locking member 22 may be engaged and/or may be activated to attach and/or to secure the locking member 22 to the second shaft 348. As a result, the cable 20 may be connected to and/or may be attached to the bracket 316 via the second shaft 348 and/or the shoulder 347 of the mounts 330*a*, 330*b*. The device 312 may be connected to and/or may be attached to the cable 20 via the connector 357 and/or the mounts 330*a*, 330*b*. As a result, the device 312 and/or the bracket 316 may be attached to, may be connected to and/or may be secured to the fixture 14 via the second shaft 348, the connector 357, the cable 20 and/or the base 320.

The user of the bracket 316 may insert the device 312 into the mounts 330*a*, 330*b* for securing the device 312 to the fixture 14. The user may position the second part 326 of the device 312 between the first shaft 346 and the base 332 of the mounts 330*a*, 330*b* as illustrated in FIG. 13. The first part 324 may be located between and/or may abut the first shaft 346 and the second wall 336 of the mounts 330*a*, 330*b*. The first shaft 346 may connect the mounts 330*a*, 330*b* via one of the apertures 342*a*-342*d* of the mounts 330*a*, 330*b*. One of the apertures 342*a*-342*d* may be based on the thickness 350 of the second part 326 of the device 312. A length 500 of the first shaft 346 may be based on the length L of the device 312. The first part 324 and/or the second part 326 of the device 312 may abut the interior surface 338 of the mounts 330*a*, 330*b*. The user may attach and/or may connect the locking member 22 to the second shaft 348. The user may activate the locking member 22 to secure the mounts 330*a*, 330*b* to the cable 20 and/or the fixture 14. As a result, the device 312 may be secured to, may be attached to and/or may be connected to the fixture 14. Moreover, the device 312 may be displayed on the fixture 14 via the mounts 330*a*, 330*b* and/or the cable 20.

The bracket 316 and/or the system 300 may attach, may connect and/or may secure the device 312 to the fixture 14. The bracket 316 may have the first mount 330*a*, the second mount 330*b* and/or the first shaft 346 for receiving and/or for securing the device 312 to the bracket 316. The second shaft 348 may be attachable to the first mount 330*a* and/or the second mount 330*b* via an orifice 357 of the first mount 330*a* and/or the second mount 330*b*. The second end 70 of the cable 20 may be connectable and/or may be attachable to the second shaft 348 of the bracket 316. The first end 68 of the cable 20 may be attached to, may be connected to and/or may be secured to the fixture 14. As a result, the device 312 and/or the bracket 316 may be attached to, may be connected to and/or may be secured to the fixture 14 via the cable 20. The shafts 346, 348 may be moved to the position P which may be based on the length L of the device 312. As a result, the bracket 316 may attach and/or may be secured to the device 312 via the first shaft 346. The mounts 330*a*, 330*b* may have the apertures 342*a*-342*e* for receiving the first shaft 348 which may be based on the thickness 350 of the second part 326 of the device 312. Moreover, the first mount 330*a* and/or the second mount 330*b* may have the coating 337 to protect the device 312.

Figure 15:
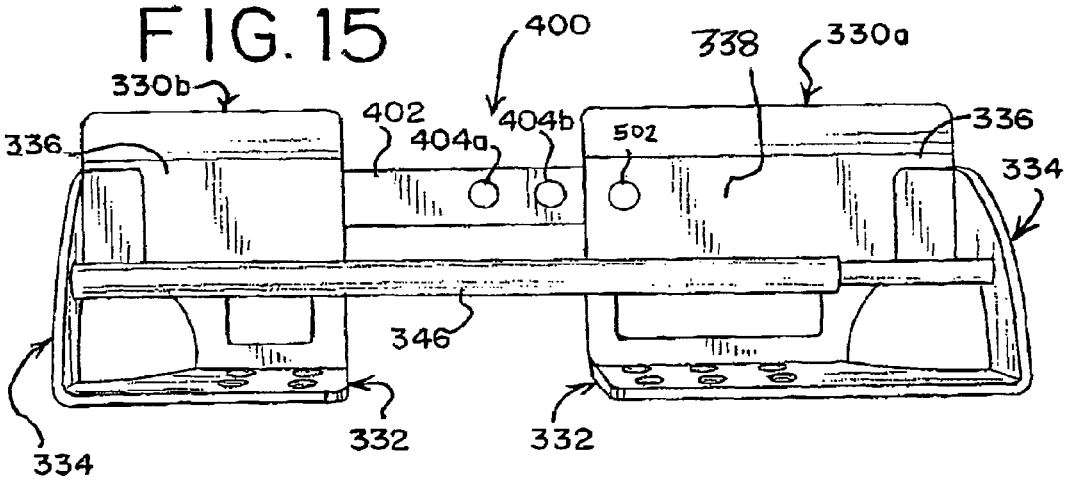
FIG. 15 illustrates a front plan view of a bracket for securing a device to a fixture in an embodiment of the present invention.
Figure 16:
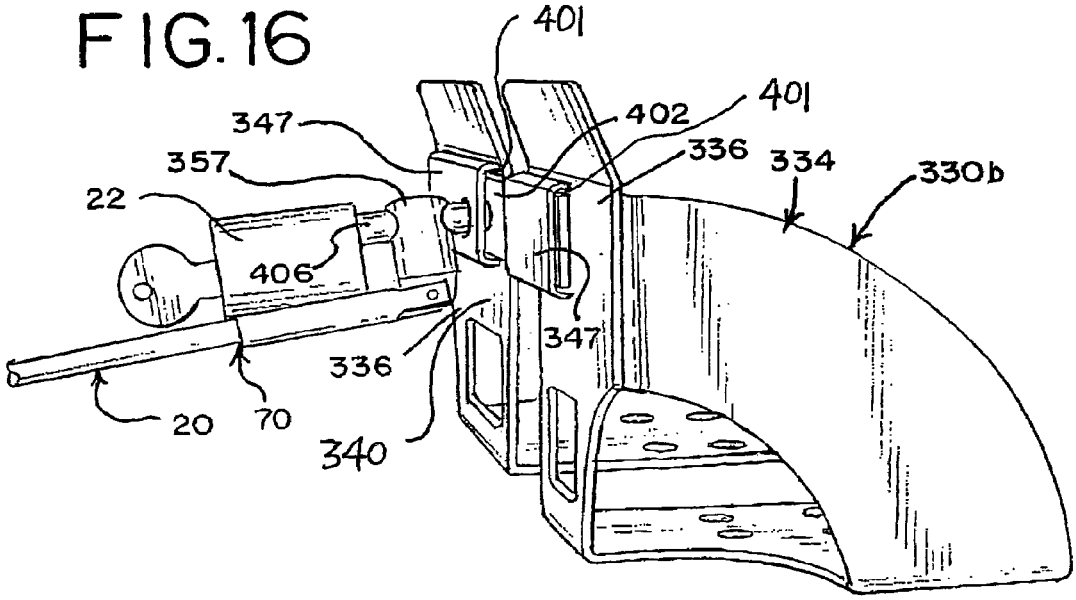
FIG. 16 illustrates a side plan view of a bracket for securing a device to a fixture in an embodiment of the present invention.

FIGS. 15 and 16 illustrate a system 400 which may attach, may connect and/or may secure the device 312 to the fixture 14 in another embodiment of the present invention. The system 400 may have the first mount 330*a*, the second mount 330*b*, the cable 20, the locking member 22 and/or the first shaft 346. The first shaft 346 may attach and/or may connect the first mount 330*a* to the second mount 330*b*. The first mount 330*a* and/or the second mount 330*b* may have the shoulder 347. The shoulder 347 may be attached to or may be integrally formed with the exterior surface 340 of the second wall 336 of the first mount 330*a* and/or the second mount 330*b*. The second wall 336 of the first mount 330*a* may have a hole 502 which may extend from the interior surface 338 through the first mount 330*a* to the exterior surface 340. The mounts 330*a*, 330*b* may have a passage 401 which may be formed between the shoulder 347 and the second wall 336 of the first mount 330*a* and/or of the second mount 330*b*, respectively.

The system 400 may have a second shaft 402 connecting and/or attaching the first mount 330*a* to the second mount 330*b*. The second shaft 402 may have the coating 337. The coating 337 may prevent the device 312 from being damaged from the second shaft 402. The second shaft 402 may be insertable into the passage 401 of the mounts 330*a*, 330*b* to attach and/or to connect the mounts 330*a*, 330*b*. The second shaft may have a first hole 404*a*, a second hole 404*b* and/or a third hole (not shown in the drawings). The first hole 404*a*, the second hole 404*b* or the third hole may correspond to the length L of the device 312

The second mount 330*b* may be moved inward or may be moved outward to the position P with respect to the first mount 330*a*. The position P may correspond to, may be based on and/or may be associated with the length L of the device 312. In the position, the hole 502 of the second wall 336 of the first mount 330*a* may align with the first hole 404*a*, the second hole 404*b* or the third hole of the second shaft 402. A pin 406 may be insertable into the hole 502 of the first mount and/or the first hole 404*a*, the second hole 404*b* or the third hole of the second shaft 402. As a result, the system 400 may have the length L of the device 312 with the second mount 330*b* in the position P with respect to the first mount 330*a*.

For example, in the position P, the hole 502 of the first mount 330*a* may align with the first hole 404*a*, the second hole 404*b* or the third hole of the second shaft 402. The first hole 404*a*, the second hole 404*b* and the third hole may correspond to a length of, for example, twelve inches, fifteen inches and eighteen inches, respectively. The pin 406 may be inserted into the hole 502 of the first mount 330*a* and the first hole 404*a*, the second hole 404*b* or the third hole of the second shaft 402. The second mount 330*b* and/or the second shaft 402 may be stationary with respect to the first mount 330*a*. As a result, system 400 may have a length corresponding to the length L of the device 312.

The second part 326 of the device 312 may be inserted and/or may be located between the first shaft 346 and the mounts 330*a*, 330*b*. The first part 324 of the device 312 may be located between the second wall 336 and the first shaft 346. Further, the first part 324 may extend outward with respect to the second wall 336 and/or the base 332 of the mounts 330*a*, 330*b*. The first shaft 346 and the mounts 330*a*, 330*b* may be sized to receive the device 312 based on the thickness 350 of the second part 326 and/or the length L of the device 312.

The second mount 330*b* and/or the second shaft 402 may be moved to the position P which may correspond to the length L of the device 312. As a result, the hole 502 of the first mount 330*a* may be aligned with the first hole 404*a*, the second hole 404*b* or the third hole of the second shaft 402. The pin 406 may be inserted into the hole 502 of the first mount 330*a* and the first hole 404*a*, the second hole 404*b* or the third hole of the second shaft 402. As a result, the second mount 330*b* and/or the second shaft 402 may be stationary with respect to the first mount 330*a* and/or the device 312. As a result, the device 312 may be attached to, may be secured to and/or may be connected to the mounts 330*a*, 330*b* via the interior surface 338 of the mounts 330*a*, 330*b*, the first shaft 346, the second shaft 402 and/or the pin 406.

A tip (not shown in the drawings) of the pin 406 may be insertable into the orifice 359 of the connector 357 and/or the locking member 22. The connector 357 may be located between the second wall 336 of the first mount 330*a* and the tip of the pin 406 and/or the locking member 22. The locking member 22 may be engaged and/or may be activated to attach, to connect, to fasten and/or to secure the pin 406 to the connector 357. The connector 357 may be attached to, may be fastened to and/or may be secured to the second end 70 of the cable 20. The first end 68 of the cable 20 may be attached to and/or may be connected to the base 320. The base 320 may be attached to, may be connected to, may be fastened to and/or may be secured to the top surface 322 of the fixture 14. As a result, the mounts 330*a*, 330*b* and/or the device 312 may be attached to, may be connected to, may be fastened to and/or may be secured to the fixture 14 via the shafts 346, 402, the pin 406, the cable 20 and/or the locking member 22. The user of the bracket 316 and/or the system 400 may insert the device 312 into the mounts 330*a*, 330*b* for securing the device 312 to the fixture 14. The user may position the second part 326 of the device 312 between the first shaft 346 and the base 332 of the mounts 330*a*, 330*b* as illustrated in FIG. 13. The first part 324 may be located between and/or may abut the first shaft 346 and the second wall 336 of the mounts 330*a*, 330*b*. The first shaft 346 may connect the mounts 330*a*, 330*b* via one of the apertures 342*a*-342*d* of the mounts 330*a*, 330*b*. One of the apertures 342*a*-342*d* may be based on the thickness of the second part 326 of the device 312. The lengths of the first shaft 346 and/or the second shaft 402 may be based on the length L of the device 312. The first part 324 and/or the second part 326 of the device 312 may abut the interior surface 338 of the mounts 330*a*, 330*b*. The user may attach and/or may connect the locking member 22 to the second shaft 348 and/or the pin 406. The user may activate the locking member 22 to secure the mounts 330*a*, 330*b* to the cable 20 and/or the fixture 14. As a result, the device 312 may be secured to, may be attached to and/or may be connected to the fixture 14. Moreover, the device 312 may be displayed on the fixture 14 via the mounts 330*a*, 330*b* and/or the cable 20.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A bracket for securing a device to a fixture wherein the device has a length defined between a first end and a second end wherein the device has a first part connected to a second part wherein the first part has a thickness, the bracket comprising:

a first mount having a base with a top side and a bottom side wherein the bottom side is opposite to the top side and further wherein the base has a wall extending outward with respect to the top side;

a second mount having a base with a top side and a bottom side wherein the bottom side is opposite to the top side and further wherein the base has a wall extending outward with respect to the top side wherein an aperture is formed in the wall of the first mount and the wall of the second mount wherein a location of the aperture in the wall of the first mount and in the wall of the second mount corresponds to the thickness of the first part of the device;

a first shaft having a length defined between a first end and a second end wherein the first shaft is insertable into the aperture of the wall of the first mount and the aperture of the wall of the second mount wherein the first shaft connects the first mount and the second mount;

a cable having a length defined between a first end and a second end wherein the first end of the cable is connectable to the first mount and the second mount; and a second shaft connecting the first mount and the second mount.

2. The bracket of claim 1 further comprising:

a shoulder attached to the wall of the first mount wherein the shoulder extends outward with respect to the base and further wherein the shoulder receives the second shaft wherein the second shaft is connected to the cable.

3. The bracket of claim 1 further comprising:

a locking member connected to the second shaft wherein the locking member secures the second shaft to the first mount and the second mount.

4. The bracket of claim 1 further comprising:

a connector attaching the cable to the first mount and the second mount wherein the connector is located between the first mount and the second mount.

5. The bracket of claim 1 wherein the length of the first shaft corresponds to the length of the device.

6. The bracket of claim 1 further comprising:

a coating on the base of the first mount and the second mount.

7. The bracket of claim 1 further comprising:

a hole formed in the base of the first mount and the second mount.

8. A system for securing a device to a fixture wherein the device has a length defined between a first end and a second end wherein the device has a first part connected to a second part wherein the first part has a thickness, the system comprising:

a bracket having a length defined between a first mount and a second mount wherein the second mount is opposite to the first mount wherein the first mount and the second mount have an interior surface and an exterior surface wherein the bracket has a plurality of apertures extending through the first mount and the second mount from the interior surface to the exterior surface;

a first shaft having a length defined between a first end and a second end wherein the second end is opposite to the first end and further wherein the first shaft inserts into one of the plurality of apertures in the first mount and into another one of the plurality of apertures in the second mount wherein the first end of the first shaft extends outward with respect to the interior surface of the first mount wherein the length of the base and the length of the first shaft correspond to the length of the device wherein the first part of the device inserts between the first shaft and the first mount and between the first shaft and the second mount wherein the second part of the device extends outward with respect to the bracket wherein the first shaft connects the device to the first mount and the second mount;

a cable having a length defined between a first end and a second end wherein the cable connects the fixture to the first mount and the second mount; and a second shaft insertable between the first mount and the second mount wherein the second shaft attaches the cable to the bracket.

9. The system of claim 8 further comprising:

a hole formed in the first mount of the bracket wherein the cable attaches to the bracket via the hole.

10. The system of claim 8 further comprising:

a locking member connected to the second shaft wherein the locking member secures the bracket and the cable.

11. The system of claim 8 further comprising:

a coating on the interior surface and the exterior surface of the first mount and the second mount.

12. A method for securing a device to a fixture wherein the device has a length defined between a first end and a second end wherein the device has a first part connected to a second part wherein the first part has a thickness, the method comprising the steps of:

providing a bracket having a first shaft connecting a first mount to a second mount wherein the second mount is located in a first position with respect Lo the first mount wherein the first mount and the second mount have a plurality of apertures wherein a location of one of the plurality of apertures in the first mount and in the second mount correspond to the thickness of the first part of the device and further wherein the first shaft inserts into the one of the plurality of apertures of the first mount and the second mount;

moving the second mount to a second position with respect to the first mount wherein the second position corresponds to the length of the device; and connecting a locking member to the bracket wherein the locking member restricts the second mount from extending outward with respect to the first mount to a third position from the second position.

13. The method of claim 12 further comprising the step of: inserting the device into the bracket.

14. The method of claim 12 further comprising the step of: attaching the bracket to the fixture.

15. The method of claim 12 further comprising the step of: connecting a cable between the fixture and the bracket.

16. The method of claim 12 further comprising the step of: separating the device from the bracket.

17. The method of claim 12 further comprising the step of: displaying the device on the fixture.

18. A bracket for securing a device to a fixture wherein the device has a length defined between a first end and a second end wherein the device has a first part connected to a second part wherein the first part hds a thickness, the bracket comprising:

a first mount having a base with a top side and a bottom side wherein the bottom side is opposite to the top side and further wherein the base has a wall extending outward with respect to the top side;

a second mount having a base with a top side and a bottom side wherein the bottom side is opposite to the top side and further wherein the base has a wall extending outward with respect to the top side wherein an aperture is formed in the wall of the first mount and the wall of the second mount wherein a location of the aperture in the wall of the first mount and in the wall of the second mount corresponds to the thickness of the first part of the device;

a first shaft having a length defined between a first end and a second end wherein the first shaft is insertable into the aperture of the wall of the first mount and the aperture of the wall of the second mount wherein the first shaft connects the first mount and the second mount;

a cable having a length defined between a first end and a second end wherein the first end of the cable is connectable to the first mount and the second mount; and a hole formed in the base of the first mount and the second mount.

* * * * *